United States Patent [19]

Lang

[11] Patent Number: 4,901,872

[45] Date of Patent: Feb. 20, 1990

[54] MULTI-TIER TOWER

[75] Inventor: Franz J. Lang, Kelkheim, Fed. Rep. of Germany

[73] Assignee: Display-Design GmbH fur moderne Verkaufsforderungsmittel and Raumausstattung, Kelkheim, Fed. Rep. of Germany

[21] Appl. No.: 220,023

[22] Filed: Jul. 15, 1988

[30] Foreign Application Priority Data

Aug. 10, 1987 [DE] Fed. Rep. of Germany ..... 3726590

[51] Int. Cl.[4] ..... A47F 3/14

[52] U.S. Cl. ..... 211/133; 108/91; 211/188; 211/194

[58] Field of Search ..... 211/133, 188, 194, 11; 108/93, 91, 111, 144; 220/23.6, 4 C, 4 D

[56] References Cited

U.S. PATENT DOCUMENTS

| | | | |
|---|---|---|---|
| 1,893,755 | 1/1933 | Wentworth | 211/133 |
| 3,346,137 | 10/1967 | Ricci | 220/23.6 |
| 3,347,186 | 10/1967 | Khattar | 108/91 |
| 3,964,810 | 6/1976 | Murphy | 108/144 X |
| 3,970,199 | 7/1976 | Marschak | 211/188 X |
| 3,999,662 | 12/1976 | Barnhardt | 211/133 |
| 4,428,487 | 1/1984 | Hepp | 211/188 X |
| 4,467,927 | 8/1984 | Nathan | 211/188 X |
| 4,480,756 | 11/1984 | Belokin, Jr. | 211/133 X |
| 4,501,369 | 2/1985 | Fox | 108/144 X |
| 4,621,740 | 11/1986 | Lang . | |
| 4,703,702 | 11/1987 | Speicher | 211/194 X |
| 4,706,824 | 11/1987 | Mercer et al. | 211/188 |
| 4,711,356 | 12/1987 | Dunden | 220/23.6 X |
| 4,763,796 | 8/1988 | Flum | 211/188 X |

FOREIGN PATENT DOCUMENTS

| | | |
|---|---|---|
| 2750663 | 6/1979 | Fed. Rep. of Germany . |
| G8403538 | 5/1984 | Fed. Rep. of Germany . |
| G8628094 | 1/1987 | Fed. Rep. of Germany . |

*Primary Examiner*—Blair M. Johnson
*Assistant Examiner*—David L. Talbott
*Attorney, Agent, or Firm*—Brumbaugh, Graves, Donohue & Raymond

[57] ABSTRACT

In a multi-tier tower for goods display, at least two platforms (10) arranged one above the other are detachably connected with one another by a plurality of spacing supports (12). Along a forward edge (16) of a base plate (14) of the respective platforms there is provided a first wall (18) directed substantially downwards therefrom and along a second edge (21) of the base plate (14) there is provided a second wall (22) directed substantially upwards. The base plate (14) is inclined downwards from the first edge to the second edge.

13 Claims, 3 Drawing Sheets

MULTI-TIER TOWER

BACKGROUND TO THE INVENTION

The invention relates to a multi-tier tower for goods display comprising at least two tier trays or plat forms arranged one above the other, which are detachably connected with one another by a plurality of spacing supports, and a standing surface for setting up on a substantially horizontal standing base, a tier tray being formed by a base plate and surrounded by a framing wall arrangement.

STATEMENT OF THE PRIOR ART

Such a multi-tier tower is known for example from DE-GM 84 03 538. In this case a tier tray is formed by a substantially horizontal plate which is enclosed all round by the framing wall arrangement. The framing wall arrangement here protrudes equally far upwards and downwards along all edges from the horizontal of the base plate of the tier tray.

OBJECT OF THE INVENTION

The invention is based upon the problem of further developing a multi-tier tower of this classification to the effect that the view of the foremost displayed goods in each case is improved and nevertheless secure stacking of the goods on the respective tier tray is guaranteed, even if the stability of standing of the goods is inherently low, as in the case of tall packages with small standing area.

SUMMARY OF THE INVENTION

To solve this problem it is proposed in accordance with the invention that the framing wall arrangement comprises along a front edge of the base plate a front wall directed substantially downwards therefrom and along a rear edge of the base plate a rear wall directed substantially upwards therefrom, and that the base plate, when the standing surface is supported on the standing base, is inclined downwards from the front to the rear edge.

In the form of embodiment according to the invention the goods standing on the respective tier tray are fully visible down to their standing surface. Due to the rearward and downward inclination of the tier tray it is ensured that the goods incline to tilt rearwards and find stable abutment on the rear wall.

By substantially wedge-shaped side walls the object can be achieved that the tier trays can be stacked in a space-saving manner, since two tier trays laid one above the other together produce in each case a substantially parallelepipedic structure. Moreover an adequate lateral stability of the displayed articles is obtained at least in the rearward region, which stability is also transmitted by frictional engagement under the action of gravity to the front articles in each case, which are then available for good inspection from the side too.

It is advisable to have the lower edges of the wedge-shaped side walls extending horizontally, especially for optical reasons, but this also has the technical advantage that inspection of the correct assembly of the shelving system is possible.

It is further advisable that when the standing surface is resting on the standing base the upper edge of a side wall extends substantially rectilinearly from the level of the base plate in the region of its front edge to the upper edge of the rear wall. Thus optimum facility of inspection in the front region and optimum stability of the displayed goods in the rear region are guaranteed, this stability again being transmitted by frictional engagement to the front articles.

In order that a separate stand foot may be saved and a tier tray may be used as stand foot, it is proposed that the standing surface is formed by the lower edges of the side walls and possibly by the lower edge of the front wall and/or the rear edge of the base plate of the lowermost tier tray.

The front edge can comprise securing means for a publicity material carrier, and these securing means can be formed as an upwardly open exchange frame for the insertion of the publicity material carrier.

As already known from DE-GM 84 03 538, the tier trays can possess a substantially rectangular outline. In general it is advisable—and this applies especially to tier trays with rectangular outline—that the tier trays are connected with one another by a total of four spacing supports, of which two are fitted in the vicinity of the front wall and two further in the vicinity of the rear wall, in each case near the side walls.

In order to guarantee an optimum view from the front, it is provided that on each side wall two double sockets are externally provided for the reception of the lower end of an upper spacing support and the upper end of a lower spacing support.

With a view to a smooth appearance from the exterior and good clearly laid-out cleanability it is advisable for the double sockets each to extend over the height of the side wall at the point concerned of the side walls.

In production technique with regard to injection-moulding it is especially advantageous if the double sockets are formed as socket tubes which are each divided by a middle wall into upper and lower socket pockets.

In order to make identical spacing supports suffice at front and rear, it is suggested that the middle walls of front and rear socket tubes be situated each in one common horizontal plane when the standing surface rests on the standing base.

In order that the spacing supports may be made with minimum possible projection in relation to the side walls, for a pre-determined resistance moment, it is advisable for the spacing supports and the double sockets each to be polygonal in cross-section and for one defining wall, close to a side wall, of each double socket to lie in the pertinent side wall plane. Especially favourable cleaning facilities result if the spacing supports and the double sockets each possess a cross-section of equilateral trapezium form and if two in each case of the defining walls of the double sockets are parallel to the respective side wall, while two further ones diverge to the outside of the respective side wall. Then dead angles which are difficult to clean are completely avoided.

In order that multi-tier towers assembled from like parts may be set together with minimum possible interspace, and likewise an alignment of the front edges of the tier trays of adjacent multi-tier shelving units may be obtained, it is provided that the double sockets on the one side wall and the double sockets on the other side wall are staggered in relation to one another by pairs in the longitudinal direction of the side walls.

BRIEF DESCRIPTION OF THE DRAWINGS

The invention is explained by reference to examples of embodiment by the accompanying Figures, wherein.

DESCRIPTION OF THE PREFERRED EMBODIMENTS

Figure 1:
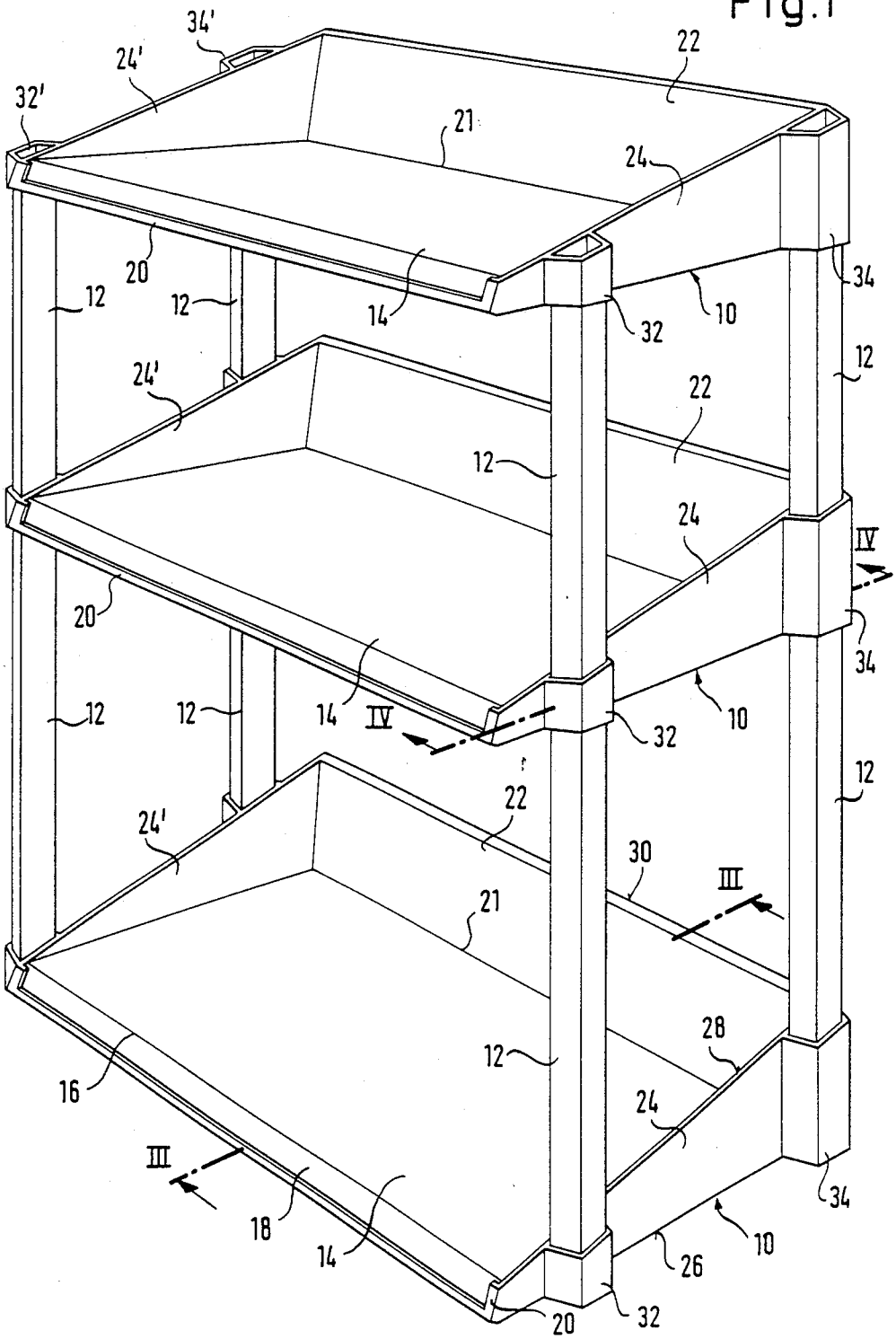
FIG. 1 shows a multi-tier tower according to the invention in perspective.

In FIG. 1 there are seen three tier trays 10 which are connected with another with spacing by four spacing supports 12 in each case. The lowermost tier tray 10 here serves as standing foot.

Figure 3:
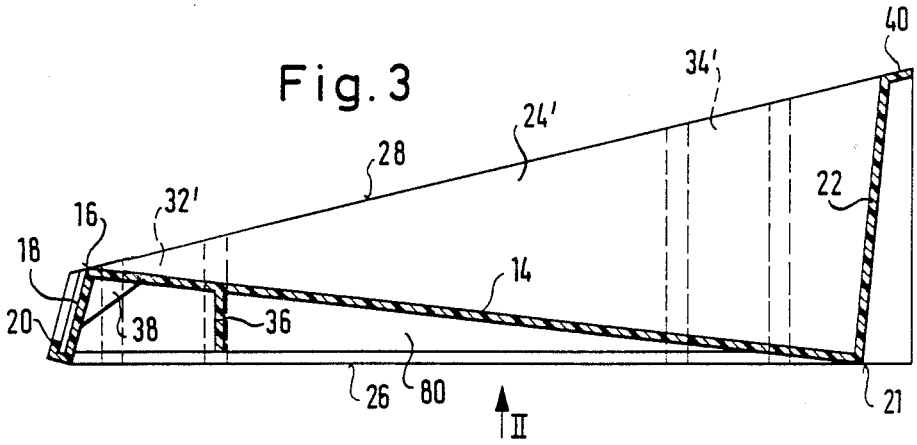
FIG. 3 shows a section along the line III—III in FIG. 1.

Each tier tray 10 comprises a base plate 14 which—as may be seen from FIG. 3—is inclined from forwards and upwards to the rear and downwards. The front edge 16 of the base plate 14 is downwardly adjoined by a front wall 18 which is made integral with an exchange frame 20 for the insertion of a publicity material carrier. The rear edge 21 of the base plate 14 is upwardly adjoined by a rear wall 22. The side walls 24, 24' are wedge-shaped—as visible from FIG. 1—with a lower edge 26 and an upper edge 28. When the multi-tier tower is in the set-up condition the lower edge 26 lies horizontally and forms a part of the standing surface. The upper edge 28 runs from the front edge 16 of the base plate 14 to the upper edge 30 of the rear wall 22.

Figure 4:
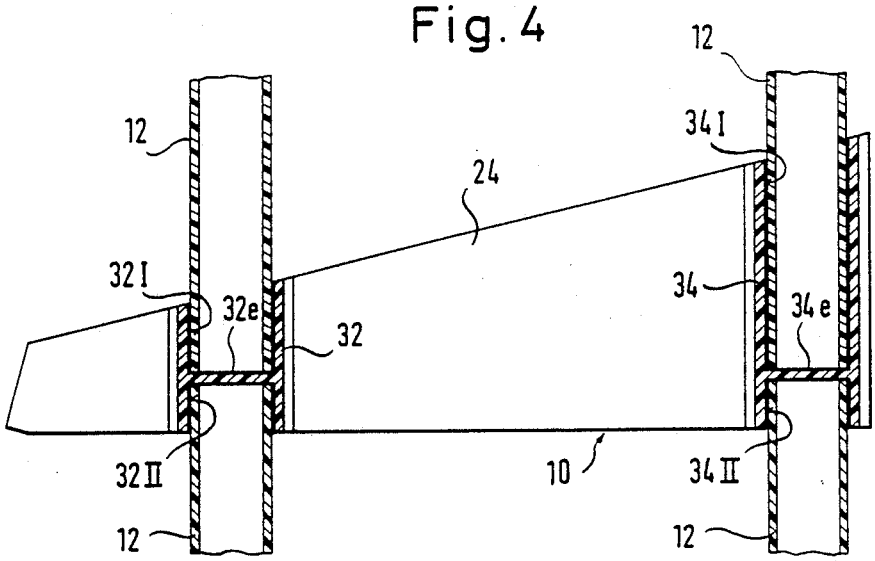
FIG. 4 shows a section along the line IV—IV in FIG. 1.

Socket tubes 32, 34 formed as double sockets are integrally provided on the side walls 24, which tubes possess different heights according to the height of the side walls 24 at the respective point of attachment. The socket tubes 32 and 34 are of trapezium-shaped cross-section—as may be seen from FIG. 2—with mutually parallel defining walls **32*a*, 34*a*, 32*b*, 34*b* and defining walls 32*c*, 34*c*, 32*d*, 34*d* diverging to the side wall 24. The defining walls 32*b*, 34*b* are parts of the side walls 24. The spacing supports 12 are corresponding trapezium-shaped hollow sections. The socket tubes—as may be seen from FIG. 4—are divided by middle walls 32*e*, 34*e* into upper and lower socket pockets 32 I, 34 I and 32 II, 34 II. Each of these socket pockets accommodates one end of an upper or lower spacing support 12. It is seen that the middle walls 32*e* and 34*e* lie at the same level. Thus different heights of the socket pockets result. On the other hand all the spacing supports 12** can be of the same length, which considerably facilitates assembly.

Figure 5:
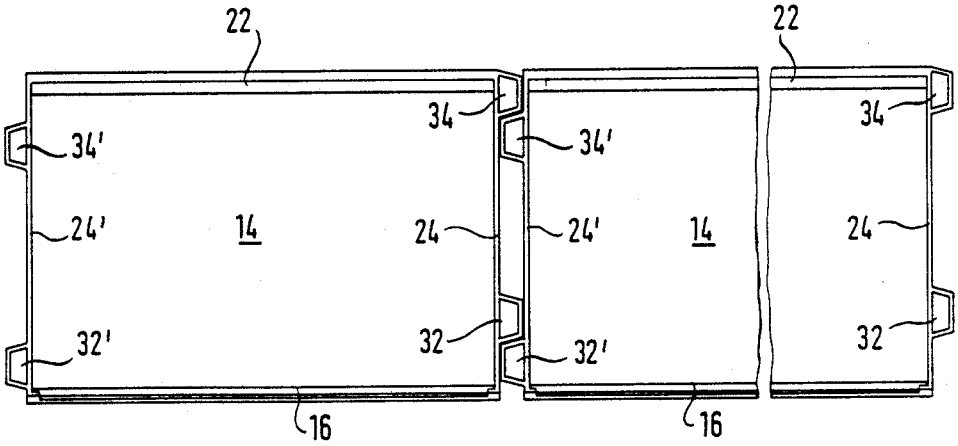
FIG. 5 shows a plan view of two adjacent tier trays of two multi-tier towers set up adjacently.

FIG. 5 shows that the socket tubes 32, 34 on the one side wall 24 are staggered in relation to the socket tubes 32', 34' on the other side wall 24' by pairs, so that a position of two adjacent multi-tier towers according to FIG. 5 is possible in which their adjacent side walls 24, 24' have minimum spacing and the front edges 16 are aligned with one another.

Figure 2:
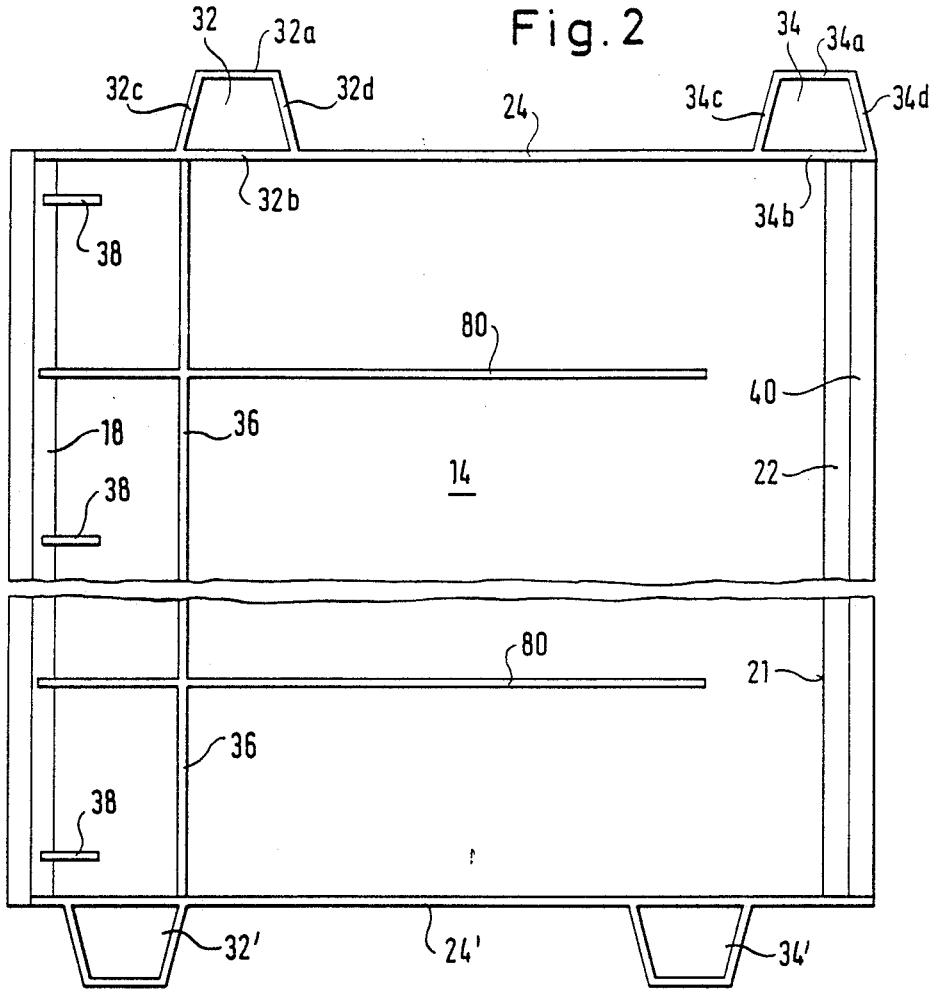
FIG. 2 shows a view of a tier tray from beneath in the direction of the arrow II in FIG. 3.

FIG. 2 shows a stiffening rib 36 on the under side of the base plate 14. The position of this stiffening rib 36 is such that despite the staggering of the socket tubes 32 and 32' it engages with both ends in each case on one of the socket tubes 32 and 32'. Furthermore FIG. 2 discloses tie elements 38 which stiffen the front wall 18 in relation to the base plate 14. The rear wall 22 is stiffened by a flange 40.

The tier trays 10 can be cast or injection-moulded in one piece from thermoplastic material. The thermoplastic material can here be opaque or preferably transparent.

Beside the already-mentioned stiffening ribs 36 still further stiffening ribs 80 extending in the depth direction of the shelf unit floor can be provided, as made clear in FIGS. 2 and 3, which stiffen the base plate 14 and the front wall 18.

I claim:

1. A multi-tier tower for goods display, comprising:

at least two platforms (10), each platform comprising a base plate 14 surrounded by a framing wall arrangement (18, 22, 24, 24'), each base plate having an upper main face, and a lower main face, the platforms arranged one above the other and detachably connected with one another by a plurality of spacing supports (12), means for providing a standing surface for setting up said tower on a substantially horizontal standing base, said framing wall arrangement (18, 22, 24, 24') comprising along a first edge (16) of the base plate (14), a first wall (18) directed substantially downwards therefrom such that said upper main face is substantially open along said first edge (16) in a direction extending beyond said first edge (10) perpendicularly with respect to said first edge (16) and parallel to said upper main face, and along a second edge (21) of the base plate (14), a second wall (22) directed substantially upwards therefrom such that said lower main face is substantially open along said second edge (21) in a direction extending beyond said second edge (21) perpendicular with respect to said second edge (21) and parallel to said lower main face, said base plate (14) being inclined downward from said first edge (16) to said second edge (21), when the standing surface is supported on the standing base, said framing wall arrangement (18, 22, 24, 24') further comprising two side walls (24, 24') of wedge shaped configuration above said upper main face, a lower edge (26) of each side wall (24, 24') extending substantially horizontally, when the standing surface is supported on the standing base, an upper edge (28) of each side wall (24) extending substantially rectilinearly from the level of said upper main face (14) in the region of said first edge (16) to an upper edge (30) of said second wall (22), when the standing surface is supported on the standing base, said base plate (14) possessing a substantially rectangular outline, adjacent platforms (10) being connected with one another by a total of four spacing supports (12) of which two are arranged in the vicinity of the first wall (18) and two are arranged in the vicinity of the second wall (22), each side wall (24, 24') being provided with two double sockets (32, 34) for the reception of the lower end of an upper spacing support (12) and the upper end of a lower spacing support (12), said double sockets (32, 34) being divided each by a middle wall (32*e*, 34*e*) into upper and lower socket pockets (32 I, 32 II, 34 I, 34 II), the middle walls (32*e*) of said double sockets (32, 32') in the vicinity of said first wall (18) and the middle walls (34*e*) of said double sockets (34, 34') in the vicinity of said second wall (22) being situated in each case in one common horizontal plane, when the standing surface is situated on the standing base, such that all spacing supports (12) of adjacent platforms (10) have equal lengths.

2. A multi-tier tower according to claim 1, characterized in that the standing surface is formed by lower edges (26) of the side walls (24, 24') and at least one of the lower edge of the first wall (18) and the rear edge (21) of the base plate (14) of the lowermost platform (10).

3. A multi-tier tower according to claim 1, characterised in that securing means (20) for publicity material carriers are fitted on the first wall (18).

4. A multi-tier tower according to claim 3, characterised in that the securing means (20) are formed by an upwardly open exchange frame for the insertion of a publicity material carrier.

5. A multi-tier tower according to claim 1, characterised in that the double sockets (32, 34) extend in each case over the height of the side wall (24, 24') at the respective point of the side walls (24, 24').

6. A multi-tier tower according to claim 1, characterized in that the double sockets (32, 34) are formed as socket tubes.

7. A multi-tier tower according to claim 1, characterised in that the spacing supports (12) and the double sockets (32, 34) are each polygonal in cross-section and in that in each case a defining wall (32*b*, 34*b*), close to a side wall, of a double socket (32, 34) lies in the pertinent side wall plane.

8. A multi-tier tower according to claim 7, characterised in that the spacing supports (12) and the double sockets (32, 34) have a quadrilateral cross-section.

9. A multi-tier tower according to claim 8, characterised in that the spacing supports (12) and the double sockets (32, 34) each possess a cross-section of equilateral trapezium form and in that of the defining walls of the double sockets (32, 34) in each case two (32*a*, 32*b*, 34*a*, 34*b*) are parallel to the respective side wall (24), while two further walls (32*c*, 32*d*, 34*c*, 34*d*) diverge towards the outside of the relevant side wall (24), 10. A multi-tier tower according to claim 1, characterised in that the double sockets (32, 34) on the one side wall (24) and the double sockets (32', 34') on the other side wall (24') are staggered in relation to one another in pairs in the longitudinal direction of the side walls (24, 24').

11. A multi-tier tower according to claim 10, characterised in that the double sockets (32, 34, 32', 34') are staggered in relation to one another by pairs so far that when two multi-tier towers assembled from identical parts are set up together, the sockets (32, 34, 32', 34') of adjacent side walls (24, 24') abust against one another in the longitudinal direction of these side walls and the first edges (16) of the base plates (14) of adjacent platforms (10) are aligned with one another.

12. A multi-tier tower according to claim 1, characterised in that the base plate (14) is stiffened on its under side by a stiffening rib (36) which extends between two double sockets (32, 32') which belong together in a pair.

13. A multi-tier tower according to claim 1, characterised in that the base plate (14) is stiffened on its under side by transversely and/or longitudinally extending stiffening ribs (36, 80).

* * * * *

UNITED STATES PATENT AND TRADEMARK OFFICE

CERTIFICATE OF CORRECTION

PATENT NO. : 4,901,872

DATED : February 20, 1990

INVENTOR(S) : Franz Josef Lang

It is certified that error appears in the above-identified patent and that said Letters Patent is hereby corrected as shown below:

Col. 5, line 28, "the pertinent" should read --a pertinent--; and

Col. 6, line 20, "abust" should read --abut--.

Signed and Sealed this

Twenty-sixth Day of March, 1991

*Attest:*

HARRY F. MANBECK, JR.

*Attesting Officer*

*Commissioner of Patents and Trademarks*